US006252568B1

(12) United States Patent
Iseki et al.

(10) Patent No.: US 6,252,568 B1
(45) Date of Patent: Jun. 26, 2001

(54) DRIVE METHOD FOR PLASMA DISPLAY PANEL

(75) Inventors: Koki Iseki; Tadashi Nakamura, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/228,926

(22) Filed: Jan. 12, 1999

(30) Foreign Application Priority Data

Jan. 13, 1998 (JP) ..... 10-004808

(51) Int. Cl.[7] ..... G09G 3/28
(52) U.S. Cl. ..... 345/60; 345/68
(58) Field of Search ..... 345/37, 41, 42, 345/204, 60–72, 208; 315/169.4

(56) References Cited

U.S. PATENT DOCUMENTS

| | | | | |
|---|---|---|---|---|
| 4,044,349 | * | 8/1977 | Andoh et al. | 345/61 |
| 5,790,087 | * | 8/1998 | Shigeta et al. | 345/67 |
| 5,854,540 | * | 12/1998 | Matsumoto et al. | 315/169.1 |
| 5,877,734 | * | 3/1999 | Amemiya | 345/60 |
| 6,020,687 | * | 2/2000 | Hirakawa et al. | 315/169.1 |

FOREIGN PATENT DOCUMENTS

| | | | |
|---|---|---|---|
| 0 657 861 | 6/1995 | (EP) | G09G/3/28 |
| 0 680 067 | 11/1995 | (EP) | H01J/17/49 |
| 2 744 276 | 8/1997 | (FR) | G09G/3/28 |
| 5-143016 | 6/1993 | (JP) | G09G/3/28 |
| 7-287548 | 10/1995 | (JP) . | |
| 8-129357 | 5/1996 | (JP) | G09G/3/28 |
| 8-335054 | 12/1996 | (JP) | G09G/1/20 |
| 9-68946 | 3/1997 | (JP) | G09G/3/28 |

OTHER PUBLICATIONS

T. Nakamura et al., "37.1: Invited Paper: Drive for 40–in.–Diagonal Full –Color ac Plasma Display", SID 95 Digest, 1995, pp. 007–810 with English Abstract.
Patent Abstracts of Japan, vol. 199, No. 707, Jul. 31, 1997.

* cited by examiner

*Primary Examiner*—Bipin Shalwala
*Assistant Examiner*—Jeff Piziali
(74) *Attorney, Agent, or Firm*—Sughrue, Mion, Zinn, Macpeak & Seas, PLLC

(57) ABSTRACT

In a conventional plasma display panel drive method, making the sustaining discharge pulse bipolar with respect to the data electrode potential prevents stable discharge in the leading sustaining discharge pulse, thereby complicating continuation to second and subsequent sustaining discharges. The plasma display panel drive method of this invention makes the potential of the leading sustaining discharge pulse a negative polarity to the data electrode potential, and moreover, makes the high-potential side of second and subsequent sustaining discharge pulses positive polarity to the data electrode potential, and makes the low-potential side negative polarity with respect to the data electrode potential.

6 Claims, 9 Drawing Sheets

Wc: SUSTAINP ELECTRODE DRIVE PULSE WAVEFORM
Ws: SCAN ELECTRODE DRIVE PULSE WAVEFORM
Wd: DATA ELECTRODE DRIVE PULSE WAVEFORM
Pw: SCAN PULSE
Pbw: SCAN BASE PULSE
Psf: SUSTAINING DISCHARGE PULSE
$Ps^+$: SUSTAINING PULSE (+)
$Ps^-$: SUSTAINING PULSE (-)
Pd: DATA PULSE

Wc: SUSTAINING ELECTRODE DRIVE PULSE WAVEFORM
Ws1 ----- Wsm: SCAN ELECTRODE DRIVE PULSE WAVEFORM
Wd: DATA ELECTRODE DRIVE PULSE WAVEFORM
Pp: PRIMING DISCHARGE PULSE
Ppe: PRIMING DISCHARGE ERASE PULSE
Pw: SCAN PULSE
Pbw: SCAN BASE PULSE
Pc, Ps: SUSTAINING PULSE
Pd: DATA PULSE

Wc: SUSTAIN ELECTRODE DRIVE PULSE WAVEFORM
Ws: SCAN ELECTRODE DRIVE PULSE WAVEFORM
Wd: DATA ELECTRODE DRIVE PULSE WAVEFORM

Wc: SUSTAINP
ELECTRODE DRIVE PULSE WAVEFORM
Ws: SCAN ELECTRODE DRIVE PULSE WAVEFORM
Wd: DATA ELECTRODE DRIVE PULSE WAVEFORM
Pw: SCAN PULSE
Pbw: SCAN BASE PULSE
Psf: SUSTAINING DISCHARGE PULSE
$Ps^+$: SUSTAINING PULSE (+)
$Ps^-$: SUSTAINING PULSE (-)
Pd: DATA PULSE

Wc: SUSTAINING ELECTRODE DRIVE PULSE WAVEFORM
Ws1 ----- Wsm: SCAN ELECTRODE DRIVE PULSE WAVEFORM
Wd: DATA ELECTRODE DRIVE PULSE WAVEFORM
$Pp^+$: PRIMING DISCHARGE PULSE (+)
$Pp^-$: PRIMING DISCHARGE PULSE (-)
Ppe: PRIMING DISCHARGE ERASE PULSE
Pw: SCAN PULSE
Pbw: SCAN BASE PULSE
Psf: SUSTAINING DISCHARGE PULSE
$Ps^+$: SUSTAINING PULSE (+)
$Ps^-$: SUSTAINING PULSE (-)
Pd: DATA PULSE

FIRST EMBODIMENT: Vsf = ¯180v

Wc: SUSTAINING ELECTRODE DRIVE PULSE WAVEFORM
Ws1 ----- Wsm: SCAN ELECTRODE DRIVE PULSE WAVEFORM
Wd: DATA ELECTRODE DRIVE PULSE WAVEFORM
$Pp^+$: PRIMING DISCHARGE PULSE (+)
$Pp^-$: PRIMING DISCHARGE PULSE (-)
Ppe: PRIMING DISCHARGE ERASE PULSE
Pw: SCAN PULSE
Pbw: SCAN BASE PULSE
Ps+: SUSTAINING PULSE (+)
Ps-: SUSTAINING PULSE (-)
Pd: DATA PULSE
Pbd: DATA BIAS PULSE

DRIVE METHOD FOR PLASMA DISPLAY PANEL

BACKGROUND OF THE INVENTION

1. Field of the Invention

The present invention relates to a drive method for a plasma display panel, and particularly to a drive method for an AC memory type plasma display panel.

2. Description of the Related Art

Plasma display panels (hereinbelow abbreviated "PDP") typically offer many features including thin construction, freedom from flicker, and a high display contrast ratio, and in addition are relatively easy to apply to large screens. They have a high response speed, and are the emissive type which can display color images using a phosphor. As a result, PDP are becoming increasingly widely used in recent years in the fields of computer-related display devices and color image display devices.

Depending on the method of operation, plasma display panels can be divided between the AC type, in which electrodes are covered by a dielectric and which are operated indirectly by AC discharge, and the DC type, in which the electrodes are exposed in a discharge space and which are operated directly by DC discharge. The AC type can be further divided between the memory type, which employs the memory of discharge cells as a drive method, and the refresh type, which doesn't make use of the discharge cell memory. The luminance of a PDP is proportional to the number of discharges, i.e., the number of repetitions of the pulse voltage. In the case of the above-described refresh type, luminance decreases with increase in the display capacity, and these displays are therefore mainly used in PDPs having a low display capacity.

FIG. 1 is a sectional view showing an example of the construction of one display cell in an AC memory type PDP. This display cell is made up of two insulator substrates 1 and 2 composed of glass, one being the front plate and the other being the rear plate; transparent scan electrode 3 and transparent sustain electrode 4 formed on insulator substrate 1; bus electrodes 5 and 6 arranged over scan electrode 3 and sustain electrode 4 to decrease the electrode resistance; data electrode 7 formed on insulator substrate 2 orthogonal to scan electrode 3 and sustain electrode 4; discharge space 8 between insulator substrates 1 and 2 filled with a discharge gas composed of, for example, helium, neon, or xenon, or a mixture of these gases; phosphor 11 for converting the ultraviolet rays generated by the above-described discharge of discharge gas into visible light 10; dielectric layer 12 that covers scan electrode 3 and sustain electrode 4; protective layer 13 composed of, for example, magnesium oxide for protecting dielectric layer 12 from discharge; and dielectric layer 14 that covers data electrode 7.

Explanation is next presented regarding the discharge operation of a selected display cell with reference to FIG. 1. When a pulse voltage that exceeds the discharge threshold value is applied between scan electrode 3 and data electrode 7 and discharge begins, positive and negative charges corresponding to the polarity of this pulse voltage are drawn to the surfaces of dielectric layers 12 and 14 on both sides, and charge is accumulated. The polarity of the equivalent internal voltage arising from this accumulation of charge, i.e., wall voltage, is the reverse of the polarity of the above-described pulse voltage, and the effective voltage inside the cell therefore decreases with the growth of discharge. Even if the above-described pulse voltage maintains a uniform value, discharge cannot be sustained and eventually stops. A sustaining discharge pulse, which is a pulse voltage of the same polarity as the wall voltage, is subsequently applied between neighboring scan electrode 3 and sustain electrode 4. This voltage combines with the wall voltage portion as the effective voltage, whereby the display cell exceeds the discharge threshold value and can discharge even if the voltage amplitude of the sustaining discharge pulse is low. Discharge can be sustained in the display cell by continually applying the sustaining discharge pulse alternately between scan electrode 3 and sustain electrode 4. This function is the memory function mentioned hereinabove. The above-described sustaining discharge can be stopped in the display cell by applying a wide low-voltage pulse or a narrow pulse, which has about the sustaining discharge pulse voltage, to scan electrode 3 or sustain electrode 4 so as to neutralize wall voltage.

FIG. 2 is a schematic plan view showing the composition of a PDP formed by arranging the display cell shown in FIG. 1 in a matrix. In the figure, PDP 15 is a dot matrix display panel in which display cells 16 are arranged in mxn rows and columns. PDP 15 is provided with scan electrodes Sc1, Sc2, . . . , Scm and sustain electrodes Su1, Su2, . . . , Sum arranged in parallel as row electrodes. PDP 15 is also provided with data electrodes D1, D2, . . . , Dn arranged as column electrodes orthogonal to the scan electrodes and sustain electrodes.

FIG. 3 is a waveform chart of drive pulses illustrating a conventional drive method (hereinbelow referred to as the "first example of the prior art") for the PDP shown in FIG. 1 proposed in the "International Symposium Digest of Technical Papers of the Society for Information Display," Volume XXVI, October 1995, pp. 807–810.

In FIG. 3, Wc is a sustain electrode drive pulse applied in common to sustain electrodes Su1, Su2, . . . , Sum; Ws1, Ws2, . . . , Wsm are scan electrode drive pulses applied to scan electrodes Sc1, Sc2, . . . , Scm, respectively; and Wd is a data electrode drive pulse applied to data electrode Di ($1 \leqq i \leqq n$). One drive period (one frame) is made up of priming discharge interval A, addressing discharge interval B, and sustaining discharge interval C, and image display is obtained through repetition of these intervals.

Priming discharge interval A is the interval for generating wall charge and active particles in the discharge space so as to obtain stable addressing discharge characteristics in addressing discharge interval B. In priming discharge interval A, after applying priming discharge pulse Pp to cause all display cells of PDP 15 to discharge simultaneously, a priming discharge erasing pulse Ppe is simultaneously applied to each scan electrode to eliminate any charge of the wall charge generated by the priming discharge interval that would impede addressing discharge and sustaining discharge. In other words, priming discharge pulse Pp is first applied to Su1, Su2, . . . , Sum, and after discharge occurs in all display cells, erasing pulse Ppe is applied to scan electrodes Sc1, Sc2, . . . , Scm to bring about erasing discharge and eliminate wall charge accumulated due to the priming discharge pulse.

In addressing discharge interval B, sequential scan pulse Pw is applied to each scan electrode Sc1, Sc2, . . . , Scm. Synchronized with this scan pulse Pw, data pulse Pd is selectively applied to data electrodes Di ($1 \leqq i \leqq n$) of those display cells that are to display, thereby bringing about addressing discharge and generating wall charge in display cells that are to display. Scan base pulse Pbw is a drive pulse that is applied to all scan electrodes in common throughout the duration of the addressing discharge interval, and is set to an amplitude whereby discharge does not occur between a scan electrode and data electrode even if data pulse Pd is applied to a data electrode.

In sustaining discharge interval C, sustaining discharge pulse Pc of negative polarity is applied to sustain electrodes, and sustaining discharge pulse Ps of negative polarity having phase delayed 180° from that of sustain electrode pulse Pc is applied to each scan electrode, thereby maintaining the sustaining discharge necessary for obtaining the desired luminance in display cells in which addressing discharge has occurred in addressing discharge interval B.

FIG. 4 is a waveform chart showing the drive method of the prior art described in Japanese Patent Laid-open No. 68946/97 (hereinbelow referred to as the "second example of the prior art").

In FIG. 4, Wc is a sustain electrode drive pulse that is applied in common to sustain electrodes Su1, Su2, . . . , Sum (corresponding to an X sustain electrodes in Japanese Patent Laid-open No. 68946/97); Ws is a scan electrode drive pulse applied to each of scan electrodes Sc1, Sc2, . . . , Scm (corresponding to Y scan electrodes in Japanese Patent Laid-open No. 68946/97); and Wd is a data electrode drive pulse applied to data electrodes Di ($1 \leqq i \leqq n$) (corresponding to address electrodes in Japanese Patent Laid-open No. 68946/97). One period of drive (one frame) is made up of priming discharge interval A (corresponding to a reset period in Japanese Patent Laid-open No. 68946/97), addressing discharge interval B (corresponding to an addressing discharge interval in Japanese Patent Laid-open No. 68946/97), and sustaining discharge C, and the desired image display is obtained through the repetition of these intervals.

The principles of driving priming discharge interval A, addressing discharge interval B, and sustaining discharge interval C are as in the first example of the prior art, and explanation is therefore here omitted. In sustaining discharge interval C, the leading sustaining discharge pulse is a negative-polarity sustaining discharge pulse (applied voltage −½ Vs; hereinbelow referred to as "negative-polarity ½ sustaining discharge pulse") substantially ½ the voltage of sustaining discharge voltage Vs that is applied to sustain electrodes, and a positive-polarity sustaining discharge pulse (applied voltage +½ Vs; hereinbelow referred to as "positive-polarity ½ sustaining discharge pulse") substantially ½ the voltage of sustaining discharge voltage Vs that is applied to scan electrodes. The second sustaining discharge pulses are a positive-polarity ½ sustaining discharge pulse that is applied to sustain electrodes and a negative-polarity ½ sustaining discharge pulse that is applied to the scan electrodes. These operations are repeated sequentially to maintain sustaining discharge (hereinbelow referred to as "bipolar sustaining discharge").

The difference between the first and second examples of the prior art lies in the sustaining discharge pulse: in the first example of the prior art, it is a negative-polarity sustaining discharge, and in the second example of the prior art, it is a bipolar sustaining discharge. The negative-polarity sustaining discharge does not make the phosphor surface on the data electrode side a cathode and can therefore prevent deterioration due to the sputtering of positive ions and thus promote longer life. In the bipolar sustaining discharge, on the other hand, voltage applied between the data electrode and scan electrode and between the data electrode and sustain electrode reaches a maximum of ½ Vs. As a result, discharge between the data electrode and the scan electrode or sustain electrode is suppressed, and sufficient sustain voltage is applied between the scan electrode and sustain electrode.

The use of a negative-polarity sustain pulse in the first example of the prior art, however, means that sustain voltage Vs is also applied between the data electrode and the scan electrode or sustain electrode, i.e., between opposite electrodes. As a result, the amplitude of sustain pulses must be lower than the initial discharge voltage between opposite electrodes, resulting in cases of insufficient sustain pulse voltage applied between the scan electrodes and sustain electrodes.

In the second example of the prior art, on the other hand, selected cells that undergo addressing discharge in the addressing period exhibit an unstable transition to discharge by the leading bipolar sustaining discharge pulse. The source of this instability can be explained as follows: First, a positive wall charge forms on the scan electrode and a negative wall charge forms on the data electrode and sustain electrode following addressing discharge in selected display cells. In the leading sustaining discharge pulse, discharge is generated by the positive-polarity ½ sustaining discharge pulse applied to the scan electrode and the negative-polarity ½ sustaining discharge pulse applied to the sustain electrode. At substantially the same time, the superimposed voltage between the positive-polarity ½ sustaining discharge pulse applied to the scan electrode and the positive wall charge on the scan electrode and the negative wall charge on the data electrode occurs discharge between opposite electrodes, thereby resulting in instability of sustaining discharge between the scan electrode and sustain electrode.

In particular, wall charge or active particles in the discharge space gradually diminish in display cells in which the time interval from addressing discharge to sustaining discharge is long. In such cells, the amount of charge is low at the time of applying a leading sustain pulse, and the leading sustaining discharge is therefore weak. If discharge between opposite electrodes occurs at the same time, the amount of charge that contributes to surface discharge is even further diminished, sufficient wall charge does not form on the scan electrode and sustain electrode in the leading sustaining discharge, and second and subsequent sustaining discharges are difficult to continue.

SUMMARY OF THE INVENTION

The object of the present invention is to provide a PDP drive method that ensures a reliable transition to sustaining discharge pulses in cells selected in an addressing discharge, and that can carry out stable sustaining discharge during the sustaining discharge interval.

The present invention: is provided with a plurality of scan electrodes and a plurality of sustain electrodes that make up pairs with the scan electrodes formed on the same flat surface; a plurality of data electrodes orthogonal to the scan electrodes and sustain electrodes; and a plurality of display cells formed at the intersections of the scan electrodes, sustain electrodes and data electrodes; includes a sustaining discharge interval following an addressing discharge, the lighting or non-lighting of each display cell being determined in the addressing discharge, and discharge being continued in the sustaining discharge interval based on the selected discharge in the addressing discharge; and, in a PDP drive method for a sustaining discharge interval, makes the potential of a leading sustaining discharge pulse a negative polarity to the data electrode potential, and moreover, makes the high potential side of second and subsequent sustaining discharge pulses a positive polarity to the data electrode potential and makes the low-potential side a negative polarity to the data electrode potential.

According to the present invention, in display cells selected in an addressing discharge, a positive wall charge forms on scan electrodes and a negative wall charge forms on sustain electrodes and data electrodes. Discharge between opposite electrodes does not occur in the leading sustaining discharge pulse interval because data electrodes are at the highest potential. Discharge occurs only between scan electrodes and sustain electrodes. In the following second and subsequent sustaining discharge pulses as well, voltage applied between opposing electrodes is suppressed and sustaining discharge is repeated.

The merit of the present invention is to enable a stable transition from addressing discharge to sustaining discharge, and moreover, to enable an expanded range of operating voltage of sustaining pulses.

This effect is achieved because the leading sustaining discharge pulse is made negative polarity to the data electrode potential, thereby preventing discharge between the data electrodes and the scan electrodes and sustain electrodes and allowing only surface discharge between scan electrodes and sustain electrodes, and because second and subsequent sustaining discharge pulses are made bipolar to the data electrode potential.

The above and other objects, features, and advantages of the present invention will become apparent from the following description based on the accompanying drawings which illustrate examples of preferred embodiments of the present invention.

DETAILED DESCRIPTION OF THE PREFERRED EMBODIMENTS

The forms of the embodiments of the present invention are next described in detail with reference to the accompanying figures.

Figure 1:
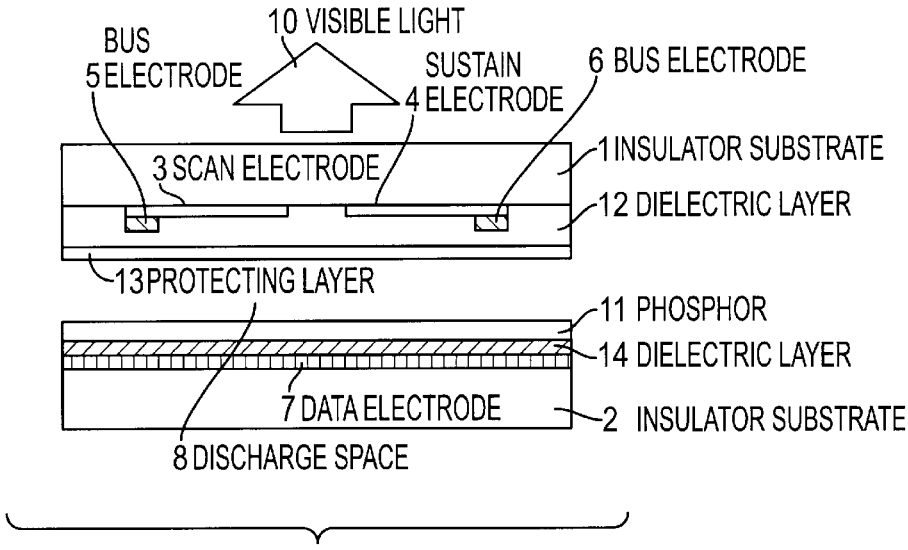
FIG. 1 (PRIOR ART)
FIG. 1 is a sectional view showing a PDP display cell.
Figure 5:
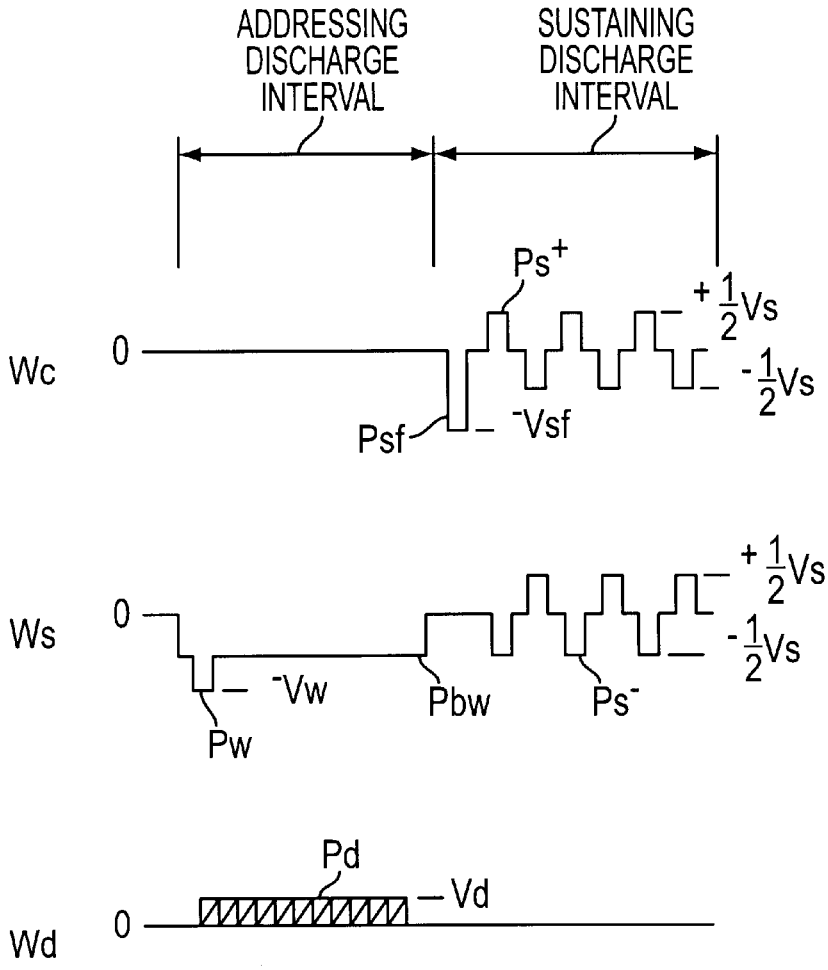
FIG. 5 is a waveform chart of drive pulses illustrating the principles of the present invention.

FIG. 5 shows a waveform chart of the drive pulses for the PDP of the present invention. The electrode configuration of the panel is the same as in the prior art, and explanation is therefore presented using FIG. 1.

As shown in FIG. 5, Wc is the sustain electrode drive pulse applied to sustain electrodes 4, Ws is the scan electrode drive pulse applied to scan electrodes 3, and Wd is the data electrode drive pulse applied to data electrodes 7.

In the addressing discharge interval, both scan pulse Pw is applied to scan electrodes 3 and data pulse Pd synchronized with this scan pulse Pw is applied to data electrodes 7 of display cells in which display is to be effected.

In the sustaining discharge interval, the data electrodes are set to the same potential as the scan electrodes, which is GND, at the time of applying the leading sustaining discharge pulse, and negative-polarity sustaining discharge pulse Psf (applied voltage Vsf) is applied to sustain electrodes.

At the time of the second sustaining discharge, a positive-polarity ½ sustaining discharge pulse, which is substantially ½ the voltage of sustaining discharge voltage Vs, is applied to sustain electrodes, and a negative-polarity ½ sustaining discharge pulse, which is substantially ½ the voltage of sustaining discharge voltage Vs, is applied to scan electrodes at the same timing. At the time of the third sustaining discharge, positive polarity and negative polarity are switched at the scan electrodes and sustain electrodes. This switching of polarity is subsequently repeated, and sustaining discharge is continued until the desired luminance is obtained.

Explanation is next presented regarding the operation of this embodiment of the present invention with reference to the figures.

In the addressing discharge interval, scan pulse Pw (applied voltage Vw) is applied to scan electrodes 3, and data pulse Pd (applied voltage Vd) is applied to selected cells at the same timing as the scan pulse. Discharge next occurs between scan electrodes 3 and data electrodes 7, and a positive wall charge forms on scan electrodes and a negative wall charge forms on data electrodes. Induced by this discharge, surface discharge occurs between scan electrodes 3 and sustain electrodes 4, and a negative wall charge forms on sustain electrodes. In the following sustaining discharge interval, a negative-polarity sustaining discharge pulse is applied to sustain electrodes as the leading sustaining discharge pulse. At this time, the wall charge formed by addressing discharge combines with this voltage, surface discharge occurs between scan electrodes and sustain electrodes, and negative wall charge forms on scan electrodes and positive wall charge forms on sustain electrodes.

Since the data electrode potential is the same as the scan electrode potential at the timing of this leading sustaining discharge pulse, the voltage added to the discharge space between the data electrodes and scan electrodes is only the wall charge formed by addressing discharge. Discharge therefore does not occur between data electrodes and scan electrodes. In addition, the data electrode potential is higher than the sustain electrode potential between the data electrodes and sustain electrodes. However, since the wall charge formed on the data electrodes is a negative charge, the voltage applied to the discharge space is decreased by the wall charge, and discharge does not occur between the data electrodes and sustain electrodes.

A negative-polarity ½ sustain pulse is applied to scan electrodes as the second sustaining discharge pulse, and a positive-polarity ½ sustain pulse is applied to sustain electrodes. As a result, the negative wall charge on scan electrodes combines with the negative-polarity ½ sustain pulse and the positive wall charge on the sustain electrodes combines with the positive-polarity ½ sustain pulse to bring about surface discharge, and a positive wall charge forms on the scan electrodes and a negative wall charge forms on the sustain electrodes.

As the third sustaining discharge pulse, the positive polarity and negative polarity are switched on the scan electrodes and sustain electrodes. Switching of polarity is subsequently repeated and sustaining discharge is continued until the desired luminance is obtained.

EMBODIMENTS

Actual embodiments of the present invention are next described with reference to the accompanying figures.

Figure 2:
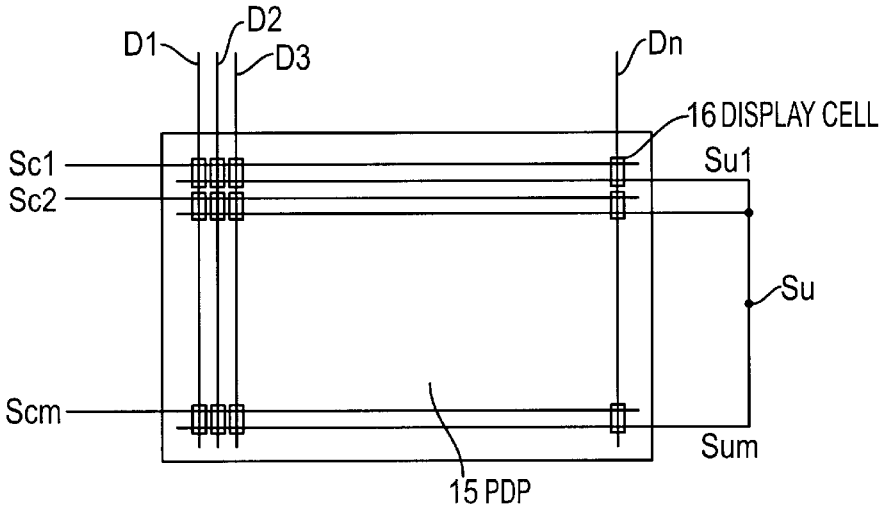
FIG. 2 (PRIOR ART)
FIG. 2 is a schematic plan view showing the arrangement of electrodes in a PDP.
Figure 3:
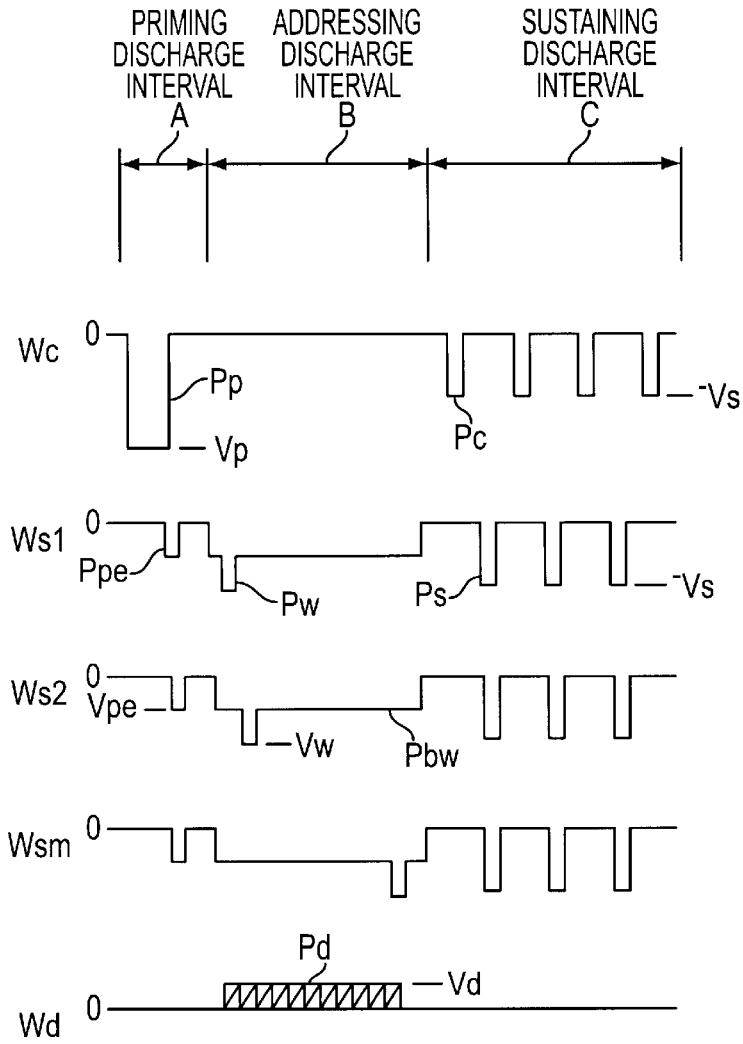
FIG. 3 (PRIOR ART)
FIG. 3 is a waveform chart of drive pulses in the first example of the prior art.
Figure 4:
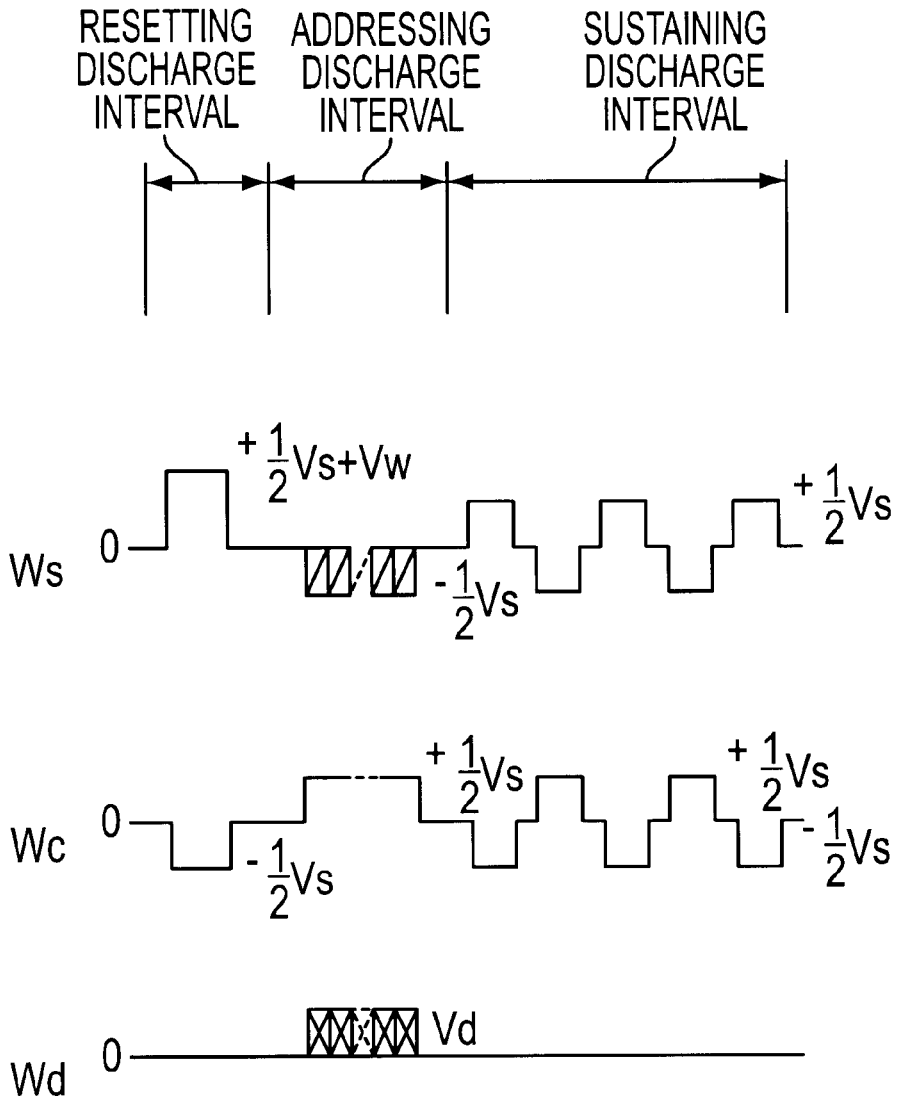
FIG. 4 (PRIOR ART)
FIG. 4 is a waveform chart of drive pulses in the second example of the prior art.
Figure 6:
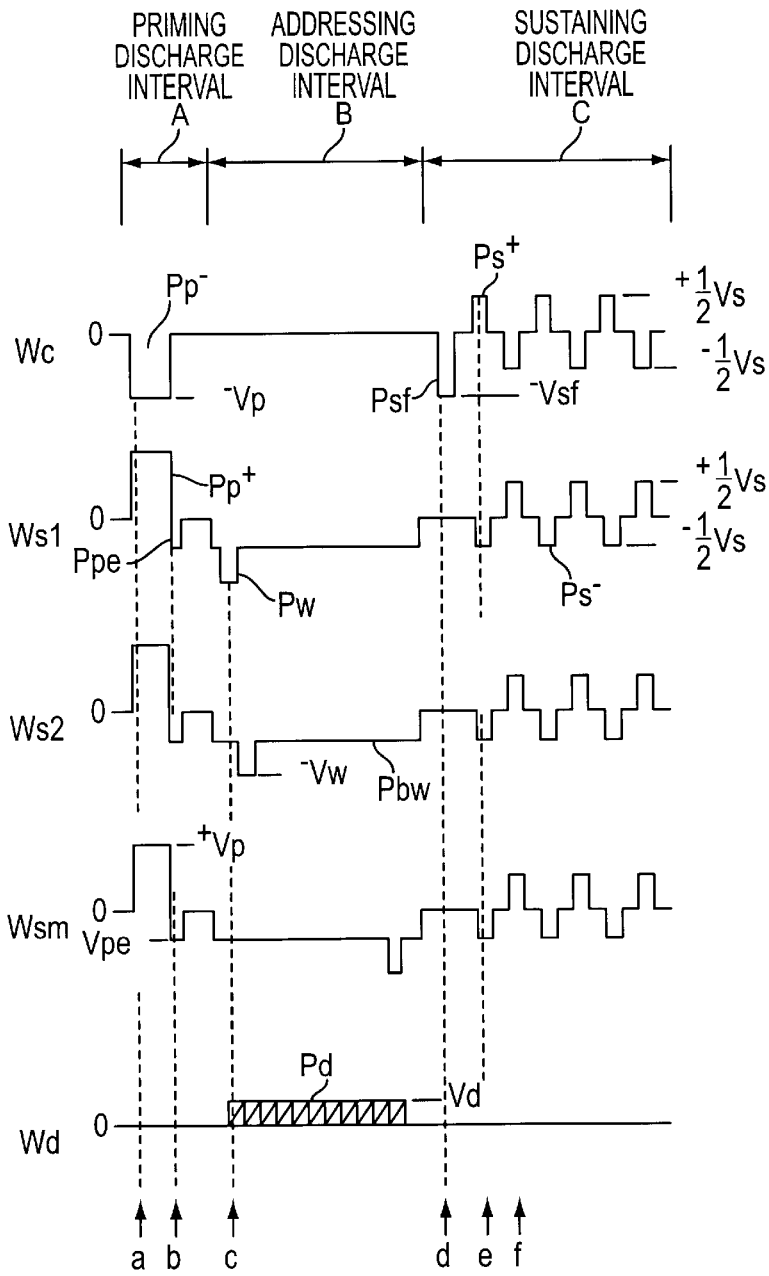
FIG. 6 is a waveform chart of drive pulses in the first embodiment of the present invention.
Figure 7A:
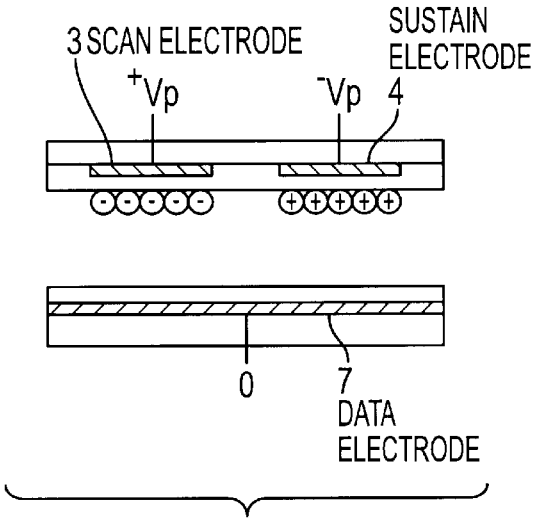
FIG. 7 is a sectional view of a display cell illustrating the applied pulse voltage and wall charge in the first embodiment of the present invention.
Figure 7D:
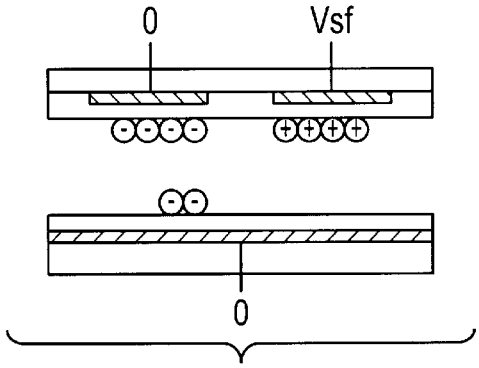
Figure 7B:
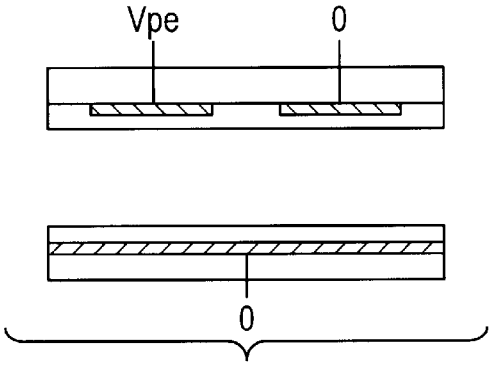
Figure 7E:
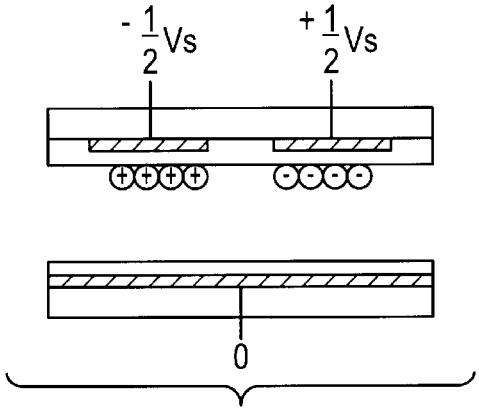
Figure 7C:
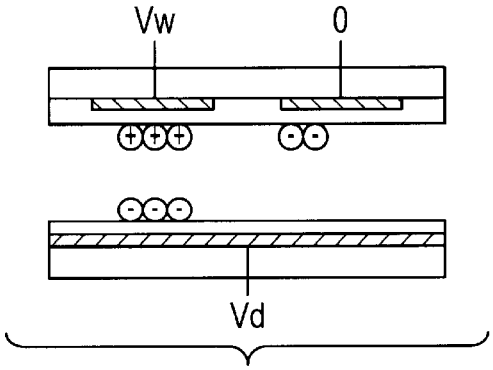
Figure 7F:
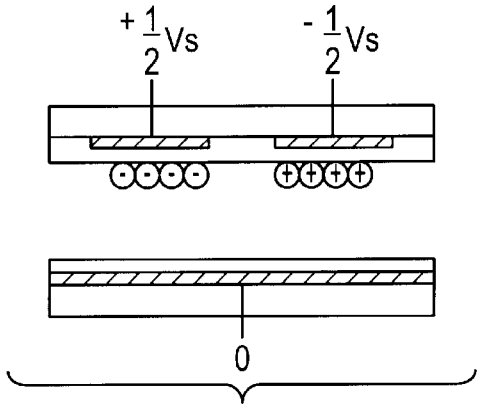

FIG. 6 is a drive waveform chart of the PDP according to the first embodiment of the present invention. The electrode structure of the panel is the same as that of the prior art, and explanation is therefore presented using FIG. 2. Wc is the sustain electrode drive waveform applied in common to sustain electrodes Su1, Su2, . . . , Sum; Ws1, Ws2, . . . , Wsm are scan electrode drive waveforms applied to scan electrodes Sc1, Sc2, . . . , Scm, respectively; and Wd is the data electrode drive waveform applied to data electrode Di ($1 \leqq i \leqq n$). One period (one frame) of drive is composed of priming discharge interval A, addressing discharge interval B, and sustaining discharge interval C; and the desired image display is obtained by he repetition of these intervals.

Priming discharge interval A is a period for generating wall charge and active particles in the discharge space so as to obtain stabilized addressing discharge characteristics in addressing discharge interval B. First, positive-polarity priming discharge pulse Pp+is applied to scan electrodes and negative-polarity priming discharge pulse Pp− is applied to sustain electrodes to cause all display cells of PDP 15 to discharge simultaneously. A priming discharge erase pulse Ppe is then applied to each scan electrode simultaneously to eliminate wall charge generated by the priming discharge.

In addressing discharge interval B, scan pulse Pw is sequentially applied to each scan electrode Sc1, Sc2, . . . , Scm. Data pulse Pd synchronized with this scan pulse Pw is selectively applied to data electrode Di ($1 \leqq I \leqq n$) of display cells in which display is to be effected, and addressing discharge generates in the display cells.

In sustaining discharge interval C, sustaining discharge pulse Psf of negative polarity is applied to sustain electrodes as the leading sustaining discharge pulse. The scan electrode potential at this time is 0 V. At the time of the second sustaining discharge, a positive-polarity ½ sustaining discharge pulse that is substantially one-half the voltage of sustaining discharge voltage Vs is applied to sustain electrodes Su1, Su2, . . . , Sum; and a negative polarity ½ sustaining discharge pulse that is substantially one-half the voltage of sustaining discharge voltage Vs is applied to scan electrodes Sc1, Sc2, . . . , Scm. At the time of third sustaining discharge, positive polarity and negative polarity are switched between the scan electrodes and sustain electrodes. Switching of polarity is subsequently repeated and sustaining discharge is continued until the desired luminance is obtained. During the sustaining discharge interval, the data electrodes are fixed at 0 V.

The operation of this embodiment of the present invention is next explained with reference to the accompanying figures.

FIG. 7 is a sectional view showing the state of wall charge at the time of applying each pulse in the display cells of PDP.

In priming discharge interval A, when priming discharge pulses Pp+(+Vp=approximately 180 V) and Pp−. (−Vp=approximtely −180 V) are applied to scan electrodes 3 and sustain electrodes 4, negative wall charge forms on scan electrodes and positive wall charge forms on sustain electrodes. (FIG. 7(*a*); timing a of FIG. 6).

Next, when priming discharge erasing pulse Ppe (Vpe=approximtely −150 V) is applied to scan electrodes 3, the wall charge formed after applying the priming discharge pulse superimposes on priming discharge erasing pulse Ppe, and discharge occurs between scan electrodes 3 and sustain electrodes 4. Priming discharge erasing pulse Ppe is a comparatively narrow pulse on the order of 1 μs, and applied voltage is therefore not held long enough for wall charge to form. Active particles therefore remain in the discharge space, and the wall charge on scan electrodes, sustain electrodes, and data electrodes is nearly eliminated. (FIG. 7(*b*); timing b of FIG. 6)

In addressing discharge interval B, scan pulse Pw (Vw=approximtely −180 V) is applied to scan electrodes 3, and data pulse Pd (Vd=approximately 70 V) is applied to selected display cells at the same timing as the scan pulse. Discharge next occurs between scan electrodes 3 and data electrodes 7, a positive wall charge forms on the scan electrodes and a negative wall charge forms on the data electrodes. (FIG. 7(*c*); timing *c* of FIG. 6)

Induced by discharge between scan electrodes 3 and data electrodes 7, surface discharge also occurs between scan electrodes 3 and sustain electrodes 4 at this time, and a negative wall charge forms on the sustain electrodes.

In sustaining discharge interval C, negative-polarity sustaining discharge pulse Psf (Vsf=approximtely −180 V) is applied to the sustain electrodes as the leading sustain pulse. The negative wall charge on the sustain electrodes and the positive wall charge on the scan electrodes generated by the addressing discharge superimpose on this pulse, whereby the voltage applied to the discharge space between scan electrodes 3 and sustain electrodes 4 exceeds the firing voltage. This superimposed voltage brings about surface discharge, and positive wall charge forms on sustain electrodes and negative wall charge forms on scan electrodes. (FIG. (*d*); timing d in FIG. 6)

The data electrode potential at the timing of this leading sustaining discharge pulse is the same as the scan electrode potential, and the voltage applied to the discharge space between data electrodes and scan electrodes therefore results only from the wall charge formed by addressing discharge. As a result, discharge does not occur between the data electrodes and scan electrodes. The data electrode potential between the data electrodes and sustain electrodes is higher than the sustain electrode potential, but since the wall charge on the data electrodes is a negative charge, the voltage applied to the discharge space is reduced by the wall charge. Consequently, discharge does not occur between data electrodes and sustain electrodes.

In the second sustaining discharge, a negative-polarity ½ sustaining discharge pulse Ps−(−½ Vs=approximtely−90 V) is applied to scan electrodes 3, and a positive-polarity ½ sustaining discharge pulse Ps+(+½ Vs=approximtely +90 V) is applied to sustain electrodes 4. The negative wall charge on scan electrodes and the positive wall charge on sustain electrodes superimposes on these voltages, the voltage applied to the discharge space between scan electrodes 3 and sustain electrodes 4 therefore exceeds the firing voltage, and surface discharge occurs. A positive wall charge forms on the scan electrodes, and a negative wall charge forms on the sustain electrodes. (FIG. 7(*e*); timing e in FIG. 6)

Following the leading sustaining discharge, a negative wall charge forms on data electrodes, and a positive wall charge forms on sustain electrodes. The positive-polarity ½ sustaining discharge pulse Ps+ to sustain electrodes therefore superimposes on these wall charges when the second sustaining discharge pulse is applied, giving rise to the possibility of discharge between data electrodes and sustain electrodes. The leading sustaining discharge, however, was only surface discharge, and a large amount of wall charge forms on scan electrodes and sustain electrodes. The time interval of leading and second sustaining discharge is therefore short, there is almost no attenuation of wall charge and the active particles in the discharge space, and discharge therefore does not subsequently destabilize sustaining discharge.

The data electrode potential at the time of the second sustaining discharge is approximately the midpoint between the scan electrode potential and sustain electrode potential, and wall charge on the data electrodes is consequently nearly eliminated by this discharge.

In the third sustaining discharge, positive-polarity ½ sustaining discharge pulse Ps+(+½ Vs=approximtely +90 V) is applied to scan electrodes 3, and negative-polarity ½ sustaining discharge pulse Ps−(−½ Vs=approximtely −90 V) is applied to sustain electrodes 4. As with the second sustaining discharge, wall charge superimposes on the applied voltage, surface discharge occurs, and negative wall charge forms on scan electrodes and positive wall charge forms on sustain electrodes. (FIG. 7(*f*); timing f in FIG. 6)

This switching of polarity is subsequently repeated and sustaining discharge is continued until the desired luminance is obtained.

Figure 8:
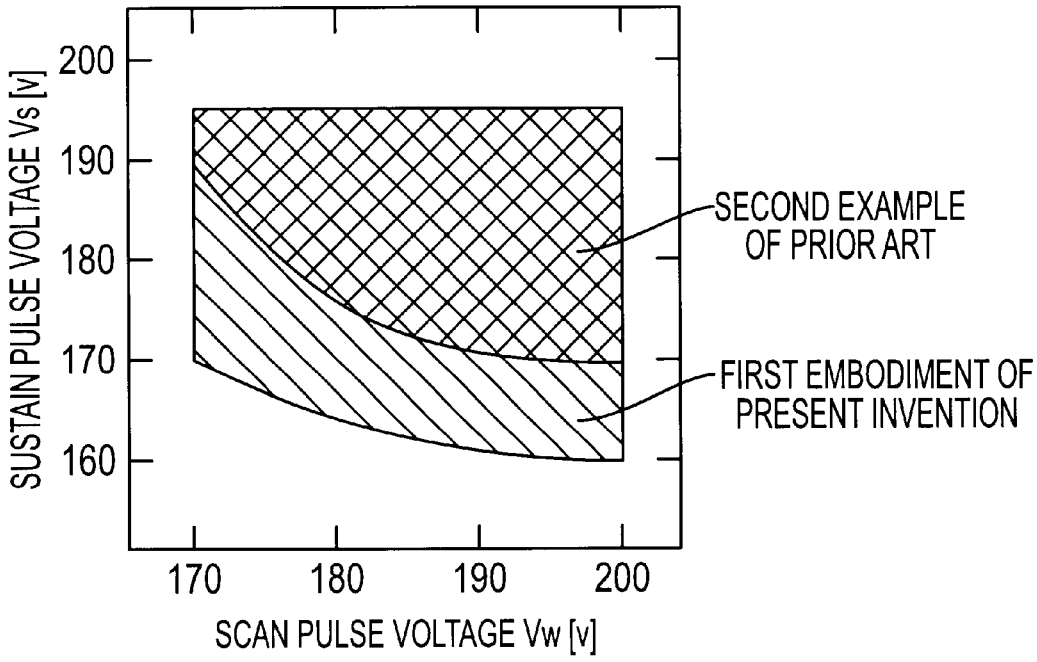
FIG. 8 is a graph showing the relation between Vw and Vs in the first embodiment of the present invention.

As described hereinabove, discharge does not occur between scan electrodes and data electrodes and between sustain electrodes and data electrodes at the time of transition from addressing discharge to sustaining discharge, i.e., at the time of applying the leading sustaining pulse (FIG. 7(*d*)). Transition from addressing discharge to sustaining discharge is held in an excellent state for effecting sustaining discharge. Further, the range of operating voltage of the second and subsequent sustaining discharge pulses can be broadened by 5–10 V as shown in FIG. 8.

Explanation is next presented regarding other embodiments of the present invention with reference to the accompanying drawings.

Figure 9:
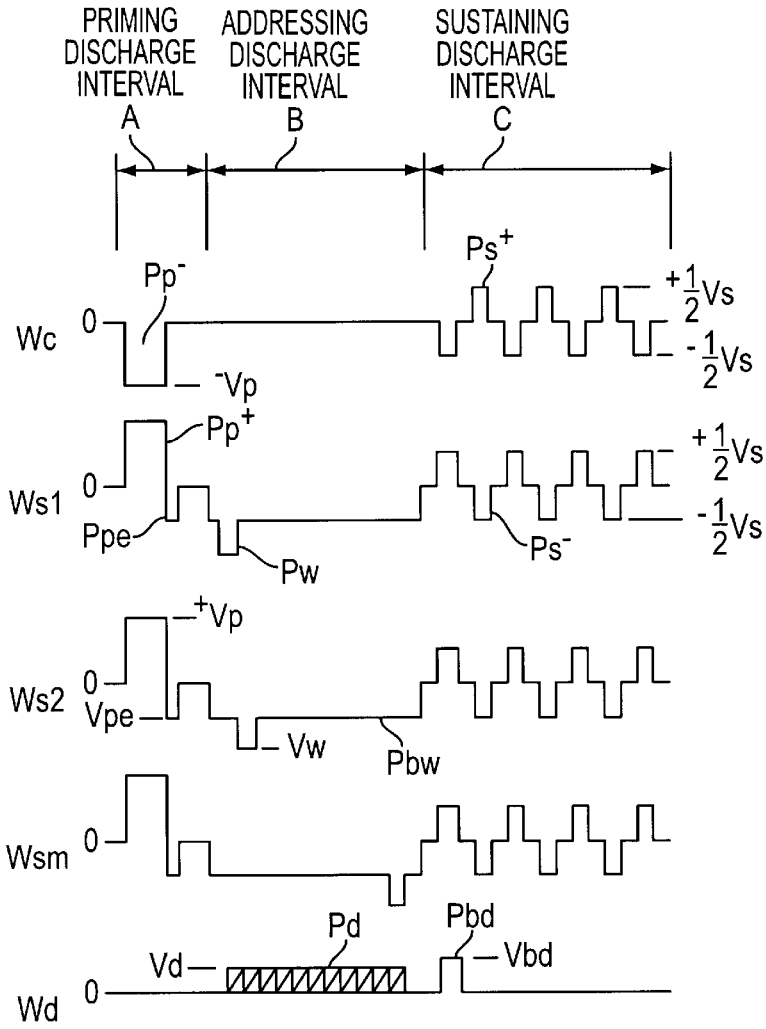
FIG. 9 is a waveform chart of drive pulses in the second embodiment of the present invention.
Figure 10A:
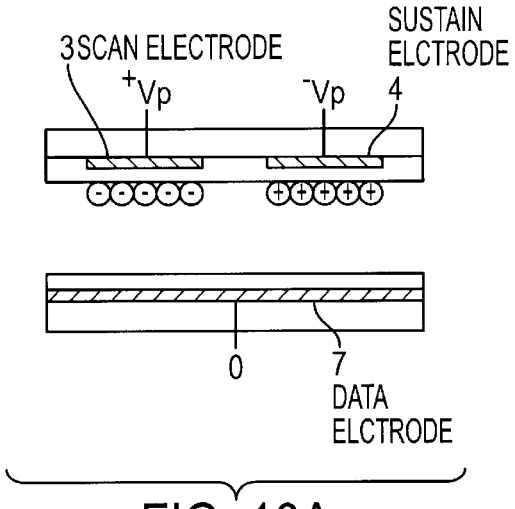
FIG. 10 is a sectional view of a display cell illustrating applied pulse voltage and wall charge in the second embodiment of the present invention.
Figure 10D:
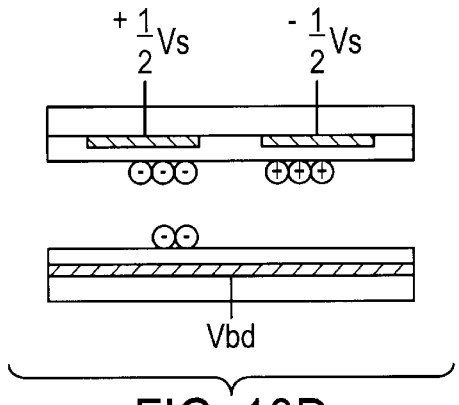
Figure 10B:
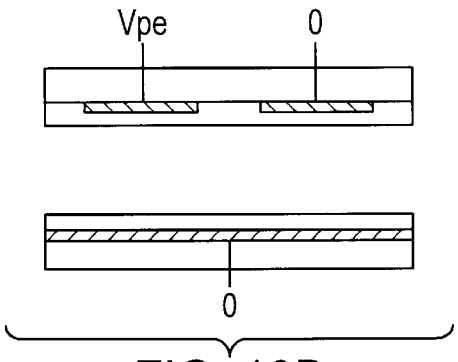
Figure 10E:
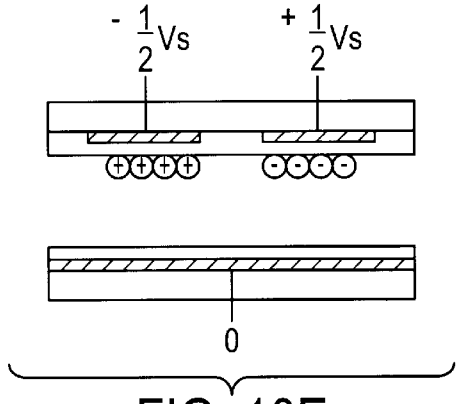
Figure 10C:
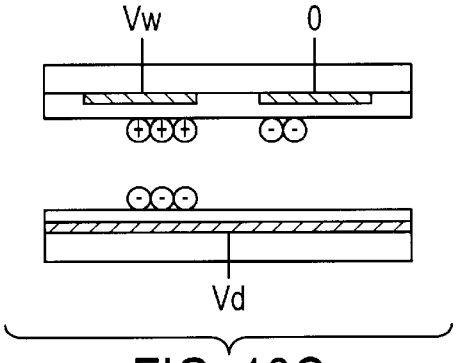
Figure 10F:
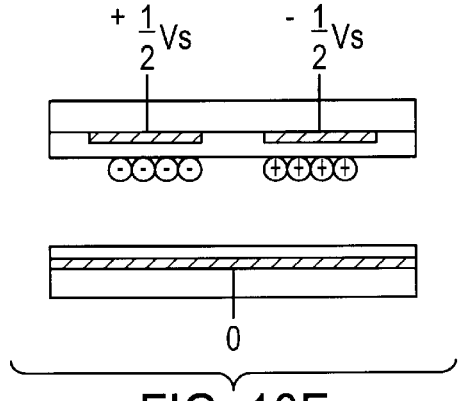

FIG. 9 shows drive waveforms of a PDP according to the second embodiment of the present invention. The panel electrode configuration is the same as that of the prior art, and explanation is therefore presented using FIG. 2. Wc is the sustain electrode drive waveform applied in common to sustain electrodes Su1, Su2, . . . , Sum; Ws1, Ws2, . . . , Wsm are the scan electrode drive waveforms applied to each of scan electrodes Sc1, Sc2, . . . , Scm, respectively; and Wd is the data electrode drive waveform applied to data electrode Di ($1 \leqq i \leqq n$). One period of drive (one frame) is composed of priming discharge interval A, addressing discharge interval B, and sustaining discharge interval C; and the desired image display is obtained by repetition of these intervals.

FIG. 10 shows sectional views of the state of the wall charge at the time of applying each pulse in a display cell of the PDP according to the second embodiment of the present invention.

Priming discharge interval A and addressing discharge interval B are the same as in the first embodiment and explanation is therefore omitted.

In sustaining discharge interval C, positive-polarity ½ sustaining discharge pulse Ps+(+½ Vs=approximately +90 V) is first applied to scan electrodes 3 as the leading sustaining discharge pulse, and negative-polarity ½ sustaining discharge pulse Ps−(−½ Vs=approximtely −90 V) is applied to sustain electrodes 4. A data bias pulse Pbd (Vbd=approximately +90 V) is applied to the data electrodes. The superposition of the negative wall charge on the sustain electrodes and the positive wall charge on scan electrodes generated by the addressing discharge causes the voltage applied to the discharge space between scan electrodes 3 and sustain electrodes 4 to exceed the firing voltage. Surface discharge therefore occurs; and positive wall charge forms on the sustain electrodes and negative wall charge forms on the scan electrodes. (FIG. 10(*d*))

The data electrode potential at the timing of this leading sustaining discharge pulse is the same as the scan electrode potential, and the voltage applied to the discharge space between data electrodes and scan electrodes therefore results only from the wall charge formed by the addressing discharge. As a result, discharge does not occur between the data electrodes and scan electrodes. In addition, the data electrode potential is higher than the sustain electrode potential between the data electrodes and scan electrodes. However, the voltage applied on the discharge space is decreased by the wall charge because the wall charge on the data electrodes is a negative charge, and discharge does not occur between the data electrodes and sustain electrodes.

In the second sustaining discharge, negative-polarity ½ sustaining discharge pulse Ps−(−½ Vs=approximtely −90 V) is applied to scan electrodes 3, and positive-polarity ½ sustaining discharge pulse Ps+(+½ Vs=approximtely +90 V) is applied to sustain electrodes 4, as in the first embodiment. The negative wall charge on the scan electrodes and the positive wall charge on the sustain electrodes superimposes on these voltages, whereby the voltage applied to the discharge space between scan electrodes 3 and sustain electrodes 4 exceeds the firing voltage. Surface discharge therefore occurs, and positive wall charge forms on the scan electrodes and negative wall charge forms on the sustain electrodes. (FIG. 10(*e*))

Following the leading sustaining discharge, a negative wall charge forms on the data electrodes and a positive wall charge forms on the sustain electrodes. When the second sustaining discharge pulse is applied, the positive-polarity ½ sustaining discharge pulse Ps+ to the sustain electrodes superimposes on these charges and there are consequently cases of discharge occurring between the data electrodes and sustain electrodes. In the leading sustaining discharge, however, only surface discharge occurs, and a large amount of wall charge is formed on the scan electrodes and sustain electrodes. As a result, the short time interval of the leading and second sustaining discharge results in almost no attenuation of the wall charge and the active particles in the discharge space, and discharge therefore does not destabilize subsequent sustaining discharge.

The data electrode potential at the time of the second sustaining discharge is approximately the midpoint between the scan electrode potential and the sustain electrode potential, and the wall charge on the data electrodes is therefore nearly eliminated by this discharge.

In the third sustaining discharge, positive-polarity ½ sustaining discharge pulse Ps+(+½ Vs=approximtely +90 V) is applied to scan electrodes 3, and negative-polarity ½ sustaining discharge pulse Ps−(−½ Vs=approximtely −90 V) is applied to sustain electrodes 4. As in the second sustaining discharge, the wall charge superimposes on the applied voltage, surface discharge occurs, and negative wall charge forms on scan electrodes, and positive wall charge forms on the sustain electrodes. (FIG. 10(*f*))

This switching of polarity subsequently repeats, and sustaining discharge is continued until the desired luminance is obtained. In addition, the data electrodes are fixed at 0 V in the second and subsequent discharges.

In this embodiment, the state of voltage applied in the leading sustaining discharge differs from that of the first embodiment, but the discharge states are equivalent because the relative difference in potential of each electrode is the same, and the transition from addressing discharge to sustaining discharge is held in an excellent state as in the first embodiment. Moreover, the range of operating voltage of the second and subsequent sustaining discharge pulses can be extended.

Moreover, since the voltage of the leading sustaining discharge pulse and the voltages of second and subsequent sustaining discharge pulses are the same, the drive circuits can be shared and circuit scale can be reduced.

The circuit scale can be further decreased if the voltage of data pulse Pd of the addressing discharge interval is common to the voltage of data bias pulse Pbd.

In the foregoing explanation, the voltage of data bias pulse Pbd was the same as the voltage of positive-polarity ½ sustaining discharge pulse Ps+, but the voltages need not be all the same if the voltage distribution is such that discharge does not occur in either selected cells and non-selected cells in the leading sustaining discharge. The voltage values need only be within a range of plus or minus 20% of the voltage of positive-polarity ½ sustaining discharge pulse Ps+. The amplitude of the positive-polarity sustaining discharge pulse and negative-polarity sustaining discharge pulse in the second and subsequent sustaining discharges need not all be the same as long as the voltage distribution does not give rise to discharge in non-selected cells.

Although explanation was given for a case in which the pulse width of data bias pulse Pdb is the same as the pulse width of leading positive-polarity ½ sustaining discharge pulse Ps+, the pulse width may be such that the pulse rises before the leading positive-polarity ½ sustaining discharge pulse, or falls after the leading positive-polarity ½ sustaining discharge and before the second sustaining pulse.

In this embodiment, explanation was given for a drive sequence in which the addressing discharge interval and sustaining discharge interval are separated in time, but separation may also be by scan line, and the present invention may be applied to a drive mode in which the addressing discharge interval and sustaining discharge interval overlap for different scan lines.

Finally, although explanation of these embodiments was given for drive sequences in which a priming discharge interval is provided before the addressing discharge interval, the priming discharge interval need not immediately precede an addressing discharge interval as long as the stability of the addressing discharge is ensured.

[For U.S.]

While preferred embodiments of the present invention have been described using specific terms, such description is for illustrative purposes only, and it is to be understood that changes and variations may be made without departing from the spirit or scope of the following claims.

What is claimed is:

1. A drive method for a plasma display panel comprising a plurality of scan electrodes, a plurality of sustain electrodes formed on the same flat surface as said scan electrodes and forming pairs with said scan electrodes, a plurality of data electrodes orthogonal to said scan electrodes and said sustain electrodes, and a plurality of display cells formed at the intersections between said data electrodes with said scan electrodes and said sustain electrodes, wherein one period of said drive is composed of an addressing discharge interval and a sustaining discharge interval, wherein said sustaining discharge interval follows an addressing discharge for determining lighting or non-lighting of each of said display cells, said sustaining discharge interval repeating discharge states based on selected discharge from said addressing discharge; said drive method for said sustaining discharge interval comprising the steps of:

(a) making a potential of a leading sustaining discharge pulse negative polarity compared to a data electrode potential, while said plurality of data electrodes and said plurality of scan electrodes are set to a same potential; and (b) making a high-potential side of second and subsequent sustaining discharge pulses positive polarity compared to the data electrode potential and making a low-potential side negative polarity compared to the data electrode potential.

2. A drive method for a plasma display panel according to claim 1, wherein said step for making the potential of said leading sustaining discharge pulse negative polarity compared to the data electrode potential, further comprises the step of:

applying said leading sustaining discharge pulse only to said sustain electrodes.

3. A drive method for a plasma display panel according to claim 1, wherein said step for making the potential of said leading sustaining discharge pulse negative polarity compared to the data electrode potential, further comprises the step of: simultaneously applying a positive-polarity leading sustaining discharge pulse to said scan electrodes, a negative-polarity leading sustaining discharge pulse to said sustain electrodes, and a positive-polarity pulse of a peak value of the positive-polarity leading sustaining discharge pulse to said data electrodes.

4. A drive method for a plasma display panel according to claim 3 wherein the pulse width of the positive-polarity pulse of the peak value of the positive-polarity leading sustaining discharge pulse applied to said data electrodes is greater than that of the leading sustaining discharge pulse, and is a positive-polarity pulse having a width not exceeding the sustaining discharge interval.

5. A drive method for a plasma display panel according to claim 3 wherein the positive-polarity pulse of peak value of the positive-polarity leading sustaining discharge pulse applied to said data electrodes is a positive-polarity pulse having a peak value that is the peak value of the leading sustaining discharge pulse ±20%.

6. A drive method for a plasma display panel according to claim 4 wherein the positive-polarity pulse of peak value of the positive-polarity leading sustaining discharge pulse applied to said data electrodes is a positive-polarity pulse having a peak value that is the peak value of the leading sustaining discharge pulse ±20%.

* * * * *